US009805652B2

(12) United States Patent
Han et al.

(10) Patent No.: US 9,805,652 B2
(45) Date of Patent: Oct. 31, 2017

(54) ORGANIC LIGHT EMITTING DISPLAY DEVICE AND METHOD OF DRIVING THE SAME

(71) Applicant: LG Display Co., Ltd., Seoul (KR)

(72) Inventors: SangKug Han, Goyang-si (KR); Mardin Kwon, Seoul (KR); KiSul Cho, Gumi-si (KR); JuhnSuk Yoo, Seoul (KR); KiSu Park, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 125 days.

(21) Appl. No.: 14/810,241

(22) Filed: Jul. 27, 2015

(65) Prior Publication Data

US 2016/0035277 A1 Feb. 4, 2016

(30) Foreign Application Priority Data

Jul. 29, 2014 (KR) ..... 10-2014-0096223
Dec. 26, 2014 (KR) ..... 10-2014-0191060

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0852* (2013.01);
(Continued)

(58) Field of Classification Search
CPC ..... G09G 3/3233; G09G 2320/046; G09G 2320/045; G09G 2310/0262; G09G 2300/0852; G09G 2300/0819
See application file for complete search history.

(56) References Cited

U.S. PATENT DOCUMENTS

2002/0158588 A1* 10/2002 Hayashi ..... G09G 3/3233 315/169.3
2013/0169702 A1* 7/2013 Ono ..... G09G 5/10 345/690

(Continued)

FOREIGN PATENT DOCUMENTS

CN 103247256 A 8/2013
CN 103578426 A 2/2014
CN 103915061 A 7/2014

OTHER PUBLICATIONS

Office Action for Chinese Patent Application No. CN 201510451008.4, dated Jun. 2, 2017, 15 Pages, (With English Translation).

*Primary Examiner* — Liliana Cerullo
(74) *Attorney, Agent, or Firm* — Fenwick & West LLP

(57) ABSTRACT

When using a flexible substrate to protect and support various components of an organic light emitting display device, among components including driving elements disposed on each of pixels of the organic light emitting display device, components where a high-level signal is applied during an emission period are grouped and are disposed on one side of the pixels. Further, components where a low-level signal is applied during the emission period are grouped and are disposed on the other side of the pixels. Accordingly, an electric field occurring due to a potential difference in the flexible substrate is minimized and shifting of a threshold voltage Vth of a thin-film transistor may be minimized. Thus, an OLED without an after-image can be provided.

12 Claims, 11 Drawing Sheets

(52) U.S. Cl.
CPC ..... *G09G 2310/0262* (2013.01); *G09G 2320/045* (2013.01); *G09G 2320/046* (2013.01)

(56) References Cited

U.S. PATENT DOCUMENTS

| | | | | |
|---|---|---|---|---|
| 2014/0034923 | A1 | 2/2014 | Kim et al. | |
| 2014/0098078 | A1* | 4/2014 | Jeon | G09G 3/3208 345/205 |
| 2014/0132584 | A1 | 5/2014 | Kim | |
| 2014/0184665 | A1 | 7/2014 | Yoon et al. | |
| 2015/0009108 | A1* | 1/2015 | Song | G09G 3/3225 345/80 |
| 2015/0054426 | A1* | 2/2015 | Han | H05B 33/0896 315/297 |

* cited by examiner

| | COMPARATIVE EXAMPLE | | EXEMPLARY EMBODIMENT | |
|---|---|---|---|---|
| NO. | G127@5s | G31@30s | G127@5s | G31@30s |
| #1 | 5.1 | 7.3 | 3.4 | 5.3 |
| #2 | −5.1 | −12.9 | 4.3 | 6.2 |
| #3 | −12.6 | −25.8 | 2.8 | 5.1 |
| #4 | −9.1 | −24.2 | 3.4 | 5.5 |
| #5 | −1.1 | −8.7 | 3.1 | 5.1 |
| #6 | 5.8 | 10.1 | 3.5 | 6.7 |
| #7 | 4.8 | 8.0 | 3.2 | 4.4 |
| #8 | −3.1 | −12.9 | 3.0 | 4.4 |
| #9 | 2.2 | 2.7 | 1.3 | 2.8 |
| #10 | 2.8 | 8.4 | 1.8 | 2.6 |
| #11 | 1.0 | 6.1 | 1.2 | 1.9 |
| #12 | 5.7 | 3.4 | 1.2 | 1.9 |
| #13 | 4.9 | 7.3 | 4.0 | 3.3 |
| #14 | 3.1 | 4.8 | 4.1 | 5.5 |
| #15 | 2.7 | 4.6 | 3.9 | 5.2 |
| #16 | 3.4 | 5.9 | 3.3 | 4.9 |
| #17 | 3.6 | 4.6 | 3.4 | 4.2 |
| #18 | 3.6 | 4.9 | 3.1 | 4.9 |
| #19 | 0.7 | 0.8 | 2.8 | 4.0 |
| #20 | 1.2 | 1.8 | 4.6 | 5.9 |
| #21 | 3.3 | 1.3 | 3.2 | 2.4 |
| #22 | 3.9 | 5.4 | 3.3 | 2.1 |
| #23 | 4.0 | 5.9 | 1.3 | 2.0 |
| #24 | 1.3 | 3.4 | 3.6 | 2.7 |
| #25 | 0.9 | 3.3 | 1.3 | 5.8 |
| #26 | 1.0 | 2.1 | 3.5 | 6.0 |
| #27 | 3.9 | 6.9 | 3.1 | 4.7 |
| #28 | 3.3 | 5.4 | 3.2 | 5.6 |
| #29 | 3.9 | 7.5 | 2.8 | 4.4 |
| #30 | 0.9 | 2.8 | 3.3 | 5.3 |

FIG. 7

ORGANIC LIGHT EMITTING DISPLAY DEVICE AND METHOD OF DRIVING THE SAME

CROSS-REFERENCE TO RELATED APPLICATIONS

This application claims the priority of Korean Patent Application No. 10-2014-0096223 filed on Jul. 29, 2014 and the priority of Korean Patent Application No. 10-2014-0191060 filed on Dec. 26, 2014, in the Korean Intellectual Property Office, the disclosure of which are incorporated herein by reference in their entirety.

BACKGROUND

Field of the Invention

The present disclosure relates to an organic light emitting display device and a method of driving the same, and more particularly, to an organic light emitting display device and a method of driving the organic light emitting display device minimized in image sticking.

Description of the Related Art

An organic light emitting display device is a self-light emitting display that does not need a separate light source unlike a liquid crystal display device, and, thus, the OLED can be manufactured into a lightweight and thin form. Further, the OLED is advantageous in terms of power consumption since it is driven with a low voltage. Also, the organic light emitting display device has excellent color expression, a high response speed, a wide viewing angle, and a high contrast ratio. Therefore, the organic light emitting display device has been researched as the next-generation display device.

In such an organic light emitting display device, image sticking has become an important technical issue. The image sticking refers to a phenomenon that, when a certain still image is switched to a full-screen image having a specific gray scale value after it has been displayed on an organic light emitting display device for a certain period of time, the profile of the previous image is seen. Such image sticking may cause deterioration in display and image qualities of an organic light emitting display device.

Accordingly, studies for reducing the time required for removing image sticking are in progress.

SUMMARY

Through an image sticking test in which a white pattern is displayed on a specific portion of a display screen and a black pattern is displayed on another specific portion of the display screen and then switched to a full-screen image having a specific gray scale value, the inventors of the present disclosure recognized that a threshold voltage Vth of a driving thin-film transistor disposed on the portion where the white pattern is displayed is shifted. Thus, a difference is generated between the threshold voltage Vth of the thin-film transistor disposed on the portion where the white pattern is displayed and a threshold voltage Vth of a thin-film transistor disposed on the portion where the black pattern is displayed. Further, the inventors of the present disclosure recognized that when a substrate on which various types of driving elements including thin-film transistors are disposed holds water as a polar molecule, so that an electric field is generated within the substrate due to a potential difference around the driving elements including the thin-film transistors (and the electrically charged water,)

and the generated electric field affects the thin-film transistors. Thus, a threshold voltage Vth of a thin-film transistor disposed on the portion where the white pattern is displayed is increased or decreased. For example, for a driving thin-film transistor that controls current applied to an organic light emitting diode, if Vth of the driving thin-film transistor is changed, the amount of current applied to the organic light emitting diode may be larger or smaller than the required amount. Thus, a problem occurs in the quality of a display.

Accordingly, the inventors of the present disclosure invented an organic light emitting display device and a method of driving the organic light emitting display device having a new pixel structure. Such structure is capable of minimizing a shift in a threshold voltage Vth of a thin-film transistor in consideration of an electric field which may be generated within a substrate due to a level difference in signal applied to each of lines and thin-film transistors during an emission period of an organic light emitting display device.

Thus, an object of the present disclosure is to provide an organic light emitting display device and a method of driving the organic light emitting display device. For even if an organic light emitting diode of the organic light emitting display device emits a light for a screen having the same gray scale value for a long time, shifts of threshold voltages Vth of thin-film transistors for driving the organic light emitting diode are minimized.

Another object of the present disclosure is to provide an organic light emitting display device and a method of driving the organic light emitting display device which is improved in image quality by rapidly removing image sticking.

The objects of the present disclosure are not limited to the aforementioned objects, and other objects, which are not mentioned above, will be apparent to a person having ordinary skill in the art from the following description.

According to an exemplary embodiment of the present disclosure, there is provided an organic light emitting display device. A plurality of pixels is defined on a flexible substrate. An organic light emitting diode is disposed on each of the plurality of pixels. A first scan line, a second scan line, an emission signal line, and an initialization voltage supply line are extended in a first direction with respect to each of the plurality of pixels, and a data line and a Vdd voltage supply line are extended in a second direction with respect to each of the plurality of pixels. Each of the plurality of pixels includes a first switching thin-film transistor, a second switching thin-film transistor, a third switching thin-film transistor, and a driving thin-film transistor. The first switching thin-film transistor is connected with the first scan line and the data line, the second switching thin-film transistor is connected with the second scan line and the initialization voltage supply line, and the third switching thin-film transistor is connected with the emission signal line and the Vdd voltage supply line. The driving thin-film transistor includes a gate electrode connected with the first switching thin-film transistor, a source electrode connected with the second switching thin-film transistor and the organic light emitting diode, and a drain electrode connected with the third switching thin-film transistor. On a plane of each of the plurality of pixels, the first scan line and the second scan line are grouped and disposed on one side and the driving thin-film transistor and the emission signal line are grouped and disposed on the other side. Thus, the components to which a high-level signal is applied during an emission period are grouped and disposed on one side of a pixel and the components to which a low-level signal is applied are grouped and disposed on the other side, minimizing a shift of a threshold voltage Vth of a thin-film transistor to be minimized.

According to an exemplary embodiment of the present disclosure, there is provided a method of driving the organic light emitting display device. The method of driving the organic light emitting display device includes: applying a pulse signal through the first scan line, the second scan line, and the emission signal line during an initialization period, a sampling period, a programming period, and an emission period. Further, during the emission period, the first scan line and the second scan line transfer a low-level signal and the emission signal line transfers a high-level signal.

According to an exemplary embodiment of the present disclosure, there is provided an organic light emitting display device. The organic light emitting display device comprises a plurality of pixels defined on a plastic substrate; and a plurality of gate lines with a first scan line, a second scan line, and an emission signal line. They are all extended in the same direction to achieve a particular configuration on the plastic substrate. Said particular configuration has one set of gate lines, to which high level signals are to be simultaneously applied, being adjacent to each other, and has another set of gate lines, to which low level signals are to be simultaneously applied, being adjacent to each other.

Details of other exemplary embodiments will be included in the detailed description of the invention and the accompanying drawings.

According to the present disclosure, the line for transferring a low-level signal and the line for transferring a high-level signal during an emission period are separately disposed. Thus, it is possible to suppress generation of an electric field, which is caused by water held in a substrate, around the thin-film transistors due to a potential difference around the thin-film transistors.

Further, according to the present disclosure, it is possible to minimize a shift of a threshold voltage Vth of the thin-film transistor, particularly, the switching thin-film transistor, for driving the organic light emitting diode.

Furthermore, according to the present disclosure, it is possible to reduce occurrence of image sticking on the organic light emitting display device and also possible to minimize the time image sticking is maintained if it occurs.

The effects of the present disclosure are not limited to the aforementioned effects, and other various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which:

FIG. 7 is a table for describing a result of the image sticking test according to Comparative Example and the exemplary embodiment.

DETAILED DESCRIPTION OF THE PREFERRED EMBODIMENT

Figure 1:
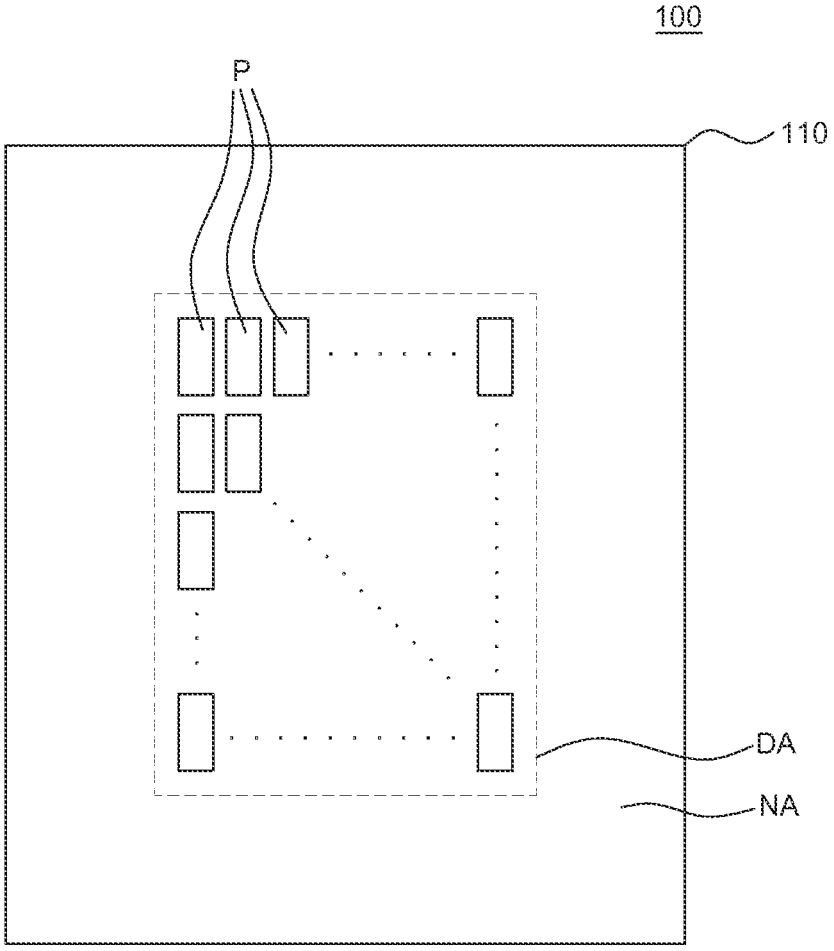
FIG. 1 is a schematic plan view for describing an organic light emitting display device according to an exemplary embodiment of the present disclosure.

Advantages and features of the present disclosure, and methods for accomplishing the same will be more clearly understood from exemplary embodiments described below with reference to the accompanying drawings. However, the present disclosure is not limited to the following exemplary embodiments but may be implemented in various different forms. The exemplary embodiments are provided only to complete disclosure of the present disclosure and to fully provide a person having ordinary skill in the art to which the present disclosure pertains with the category of the invention, and the present disclosure will be defined by the appended claims.

The shapes, sizes, ratios, angles, numbers, and the like shown in the accompanying drawings for describing the exemplary embodiments of the present disclosure are merely examples, and the present disclosure is not limited thereto. Like reference numerals generally denote like elements throughout the present specification. Further, in the following description, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", "next" and the like, one or more parts may be positioned between the two parts unless the terms are used with the term "immediately" or "directly" is not used.

When an element or layer is referred to as being "on" another element or layer, it may be directly on the other element or layer, or intervening elements or layers may be present.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Throughout the whole specification, the same reference numerals denote the same elements.

Since size and thickness of each component illustrated in the drawings are represented for convenience in explanation, the present disclosure is not necessarily limited to the illustrated size and thickness of each component.

The features of various embodiments of the present disclosure can be partially or entirely bonded to or combined with each other and can be interlocked and operated in technically various ways as can be fully understood by a person having ordinary skill in the art, and the embodiments can be carried out independently of or in association with each other.

Hereinafter, various exemplary embodiments of the present disclosure will be described in detail with reference to the accompanying drawings.

FIG. 1 is a schematic plan view for describing an organic light emitting display device according to an exemplary embodiment of the present disclosure. FIG. 1 illustrates only a flexible substrate 110 of various components included in an organic light emitting display device 100.

The flexible substrate 110 is configured to support and protect various components of the organic light emitting display device 100. The flexible substrate 110 may be formed of an insulating material having flexibility. For example, the flexible substrate 110 may be formed of plastic such as polyimide, but is not limited thereto.

If the flexible substrate 110 is formed of a plastic substrate, the flexible substrate 110 may contain a material which may cause an electric field therein depending on a property of a plastic material. For example, the flexible substrate 110 may contain water.

The flexible substrate 110 includes a display area DA and a non-display area NA surrounding the display area DA. The display area DA is an area where an image is displayed on the organic light emitting display device 100, and a plurality of pixels P is defined on the display area DA. Further, in each of the plurality of pixels, an organic light emitting diode OLED and various driving components for driving the organic light emitting diode OLED are disposed. The various driving components for driving the organic light emitting diode OLED will be described later in detail with reference to FIG. 2 to FIG. 4. The non-display area NA is an area where an image is not displayed on the organic light emitting display device 100 and an area where a line or a circuit unit is formed. Further, a plurality of pad electrodes may be formed in the non-display area NA, and, thus, an external module, for example, an FPCB (flexible printed circuit board), a COF (chip on film), bonded to the pad electrodes may be disposed in the non-display area NA.

In the following description, the driving components disposed in each of the plurality of pixels P of the organic light emitting display device 100 and a method of driving the same will be described in more detail with reference to FIG. 2 and FIG. 3.

Figure 2:
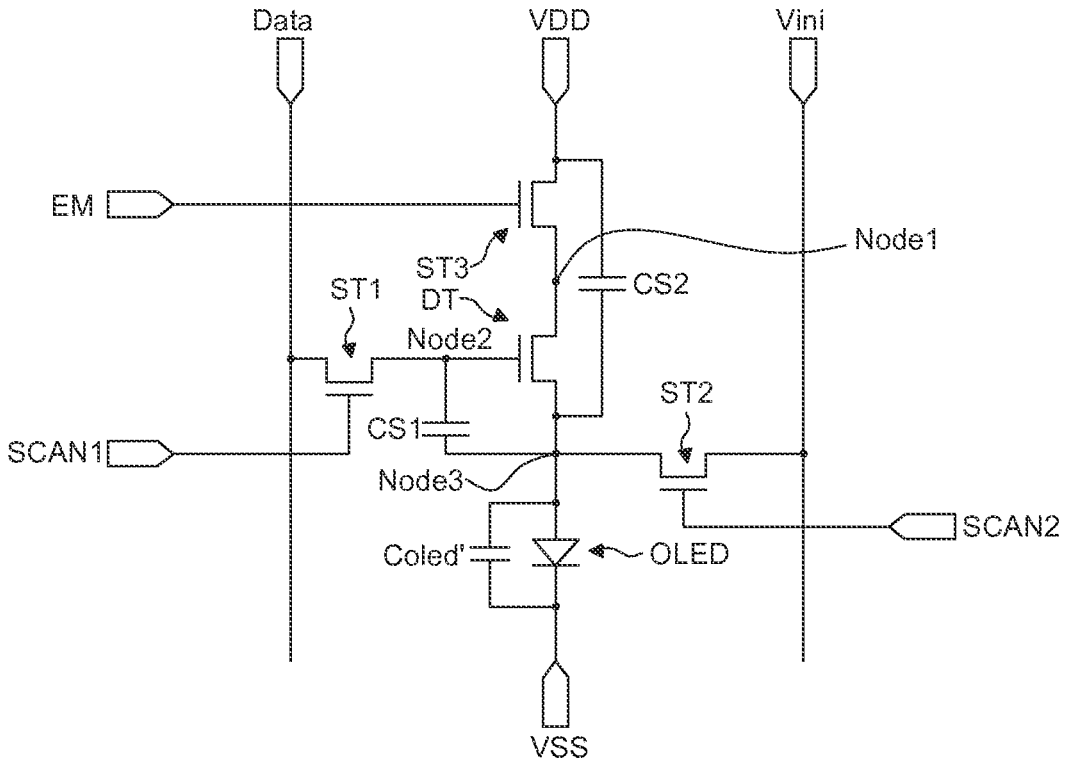
FIG. 2 is a schematic circuit diagram of an organic light emitting display device according to an exemplary embodiment of the present disclosure.

FIG. 2 is a schematic circuit diagram of an organic light emitting display device according to an exemplary embodiment of the present disclosure. FIG. 3 is a schematic timing diagram for describing a method of driving an organic light emitting display device according to an exemplary embodiment of the present disclosure. Referring to FIG. 2, each pixel P of the organic light emitting display device 100 includes: an organic light emitting diode OLED, a first switching thin-film transistor ST1, a second switching thin-film transistor ST2, a third switching thin-film transistor ST3, a driving thin-film transistor DT, a first capacitor CS1, and a second capacitor CS2. In the present specification, such a pixel P may be referred to as having a 4T2C pixel circuit.

The pixel P is operated in a plurality of periods, i.e., an initialization period t1, a sampling period t2, a programming period t3, and an emission period t4, divided by a plurality of scan signals supplied to the pixel circuit. Further, a first scan line SCAN1, a second scan line SCAN2, an emission signal line EM, and an initialization voltage supply line Vini apply a pulse signal comprised of a high-level signal and a low-level signal to the pixel circuit during each of the plurality of periods.

Referring to FIG. 2, the first switching thin-film transistor ST1 is connected with the first scan line SCAN1 and a data line Data. To be specific, a gate electrode of the first switching thin-film transistor ST1 is connected with the first scan line SCAN1 and one terminal of the first switching thin-film transistor ST1 is connected with the data line Data. Further, the other terminal of the first switching thin-film transistor ST1 is connected with a gate electrode of the driving thin-film transistor DT. Herein, the one terminal and the other terminal may be one of a source electrode and a drain electrode. The first scan line SCAN1, the second scan line SCAN2, and the emission signal line EM are referred to a plurality of gate lines. The plurality of gate lines may extend in the same direction to achieve a particular configuration on the plastic substrate. The particular configuration may have two sets of gate lines. High level signals may be simultaneously applied to the first set of gate lines, and low level signals may be simultaneously applied to second set of gate lines. Each of the sets of gate lines may be adjacent to each other.

Figure 3:
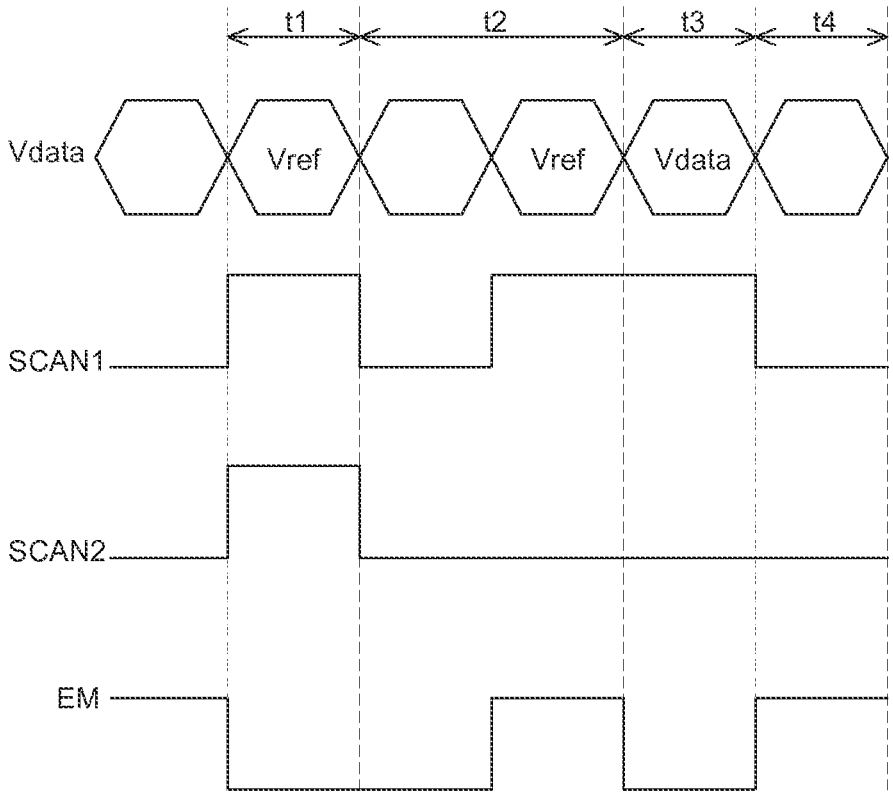
FIG. 3 is a schematic timing diagram for describing a method of driving an organic light emitting display device according to an exemplary embodiment of the present disclosure.

Referring to FIG. 2 and FIG. 3, the first switching thin-film transistor ST1 is turned on or turned off on the basis of a state of a first scan signal from the first scan line SCAN1. An operation of turning on the first switching thin-film transistor ST1 connects a second node Node2 connected with a gate electrode of the driving thin-film transistor DT with the data line Data. The first scan signal of a high level is supplied to the first switching thin-film transistor ST1 during the initialization period t1 and the sampling period t2, so that the first switching thin-film transistor ST1 is turned on. Further, the first scan signal of a high level is also supplied to the first switching thin-film transistor ST1 during the programming period t3. The data line Data supplies a data voltage Vdata during the programming period t3, and then, the first switching thin-film transistor ST1 supplies the data voltage Vdata to the second node Node2.

Referring to FIG. 2, the second switching thin-film transistor ST2 is connected with the second scan line SCAN2 and the initialization voltage supply line Vini. To be specific, a gate electrode of the second switching thin-film transistor ST2 is connected with the second scan line SCAN2, one terminal of the second switching thin-film transistor ST2 is connected with the initialization voltage supply line Vini, and the other terminal of the second switching thin-film transistor ST2 is connected with a third node Node3. Herein, the one terminal and the other terminal may be one of a source electrode and a drain electrode.

Referring to FIG. 2 and FIG. 3, the second switching thin-film transistor ST2 is turned on or turned off on the basis of a state of a second scan signal from the second scan line SCAN2. The second scan signal of a high level is supplied to the second switching thin-film transistor ST2 during the initialization period t1, so that the second switching thin-film transistor ST2 is turned on, and an initialization voltage is supplied to a third node Node3 connected with a source electrode of the driving thin-film transistor DT.

Referring to FIG. 2, the third switching thin-film transistor ST3 is connected with the emission signal line EM and a Vdd voltage supply line VDD. To be specific, a gate electrode of the third switching thin-film transistor ST3 is connected with the emission signal line EM, one terminal of the third switching thin-film transistor ST3 is connected with the Vdd voltage supply line VDD, and the other terminal of the third switching thin-film transistor ST3 is connected with a first node Node1. Herein, the one terminal and the other terminal may be one of a source electrode and a drain electrode.

Referring to FIG. 2 and FIG. 3, the third switching thin-film transistor ST3 is turned on or turned off on the basis of a state of an emission signal from the emission signal line EM. The emission signal of a high level is supplied to the third switching thin-film transistor ST3 during the sampling period t2 and the emission period t4, so that the third switching thin-film transistor ST3 is turned on. Further, the third switching thin-film transistor ST3 supplies a Vdd voltage to a drain electrode of the driving thin-film transistor DT from the Vdd voltage supply line VDD.

Referring to FIG. 2, the driving thin-film transistor DT is connected with the first switching thin-film transistor ST1, the second switching thin-film transistor ST2, the third switching thin-film transistor ST3, and the organic light emitting diode OLED. To be specific, the gate electrode of the driving thin-film transistor DT is connected with one terminal of the first switching thin-film transistor ST1, the drain electrode of the driving thin-film transistor DT is connected with one terminal of the third switching thin-film transistor ST3, and the source electrode of the driving thin-film transistor DT is connected with one terminal of the second switching thin-film transistor ST2 and the organic light emitting diode OLED.

Herein, the first switching thin-film transistor ST1, the second switching thin-film transistor ST2, the third switching thin-film transistor ST3, and the driving thin-film transistor DT are LTPS (Low Temperature Poly Silicon) thin-film transistors. That is, as an active layer in each of the first switching thin-film transistor ST1, the second switching thin-film transistor ST2, the third switching thin-film transistor ST3, and the driving thin-film transistor DT, there may be used an active layer which is formed of low-temperature polycrystalline silicon by performing a heat treatment thereto, for example, an amorphous silicon layer with a laser beam or the like.

The organic light emitting diode OLED includes an anode configured to receive a Vdd voltage, a cathode configured to receive a $V_{SS}$ voltage, and an organic light emitting layer disposed between the anode and the cathode. The organic light emitting diode OLED is connected in series with the driving thin-film transistor DT between the Vdd voltage supply line VDD and a $V_{SS}$ voltage supply line VSS. To be specific, the anode of the organic light emitting diode OLED is connected with the source electrode of the driving thin-film transistor DT through the third node Node3, and the cathode of the organic light emitting diode OLED is connected with the $V_{SS}$ voltage supply line VSS. The driving thin-film transistor DT controls an amount of current flowing into the organic light emitting diode OLED depending on a voltage difference between the source electrode and the gate electrode of the driving thin-film transistor DT. The driving thin-film transistor DT supplies a driving current to the organic light emitting diode OLED during the emission period t4 during which the organic light emitting diode OLED emits light.

Referring to FIG. 2, the first capacitor CS1 is connected between the second node Node2 and the third node Node3. To be specific, the first capacitor CS1 is connected between the source electrode of the driving thin-film transistor DT and the gate electrode of the driving thin-film transistor DT. The first capacitor CS1 stores a threshold voltage Vth of the driving thin-film transistor DT during the sampling period t2.

Referring to FIG. 2, the second capacitor CS2 is connected between the Vdd voltage supply line VDD and the second node Node2. To be specific, the second capacitor CS2 is connected between the Vdd voltage supply line VDD and the drain electrode of the driving thin-film transistor DT. The second capacitor CS2 is connected in series with the first capacitor CS1 to reduce a capacitance ratio of the first capacitor CS1. Since the second capacitor CS2 reduces a capacitance ratio of the first capacitor CS1 as such, it is possible to more efficiently use the data voltage Vdata applied to the second node Node2 during the programming period t3. Accordingly, the second capacitor CS2 can improve the luminance of the organic light emitting diode OLED at the same data voltage Vdata.

Regarding a specific driving of the organic light emitting display device 100 according to an exemplary embodiment of the present disclosure, the first switching thin-film transistor ST1 and the second switching thin-film transistor ST2 are turned on during the initialization period t1. Accordingly, a reference voltage Vref is supplied to the second node Node2 via the first switching thin-film transistor ST1 through the data line Data. Further, the initialization voltage Vini is supplied to the third node Node3 through the initialization voltage supply line Vini. Accordingly, the pixel P is initialized.

Then, the first switching thin-film transistor ST1 and the third switching thin-film transistor ST3 are turned on during the sampling period t2. The second node Node2 maintains the reference voltage Vref. In a state where the drain electrode of the driving thin-film transistor DT is floated by the Vdd voltage of a high level, a current flows toward the source electrode of the driving thin-film transistor DT. If the source electrode of the driving thin-film transistor DT has a voltage equivalent to "Vref−Vth", the driving thin-film transistor DT is turned off Herein, "Vth" represents the threshold voltage Vth of the driving thin-film transistor DT.

Then, the first switching thin-film transistor ST1 is turned on and the data voltage Vdata is supplied to the second node Node2 via the first switching thin-film transistor ST1 through the data line Data during the programming period t3. Accordingly, a voltage of the third node Node3 is changed to "Vref−Vth+C'(Vdata−Vref)" due to a coupling phenomenon within the pixel circuit. This results from a voltage distribution caused by the serial connection between the first capacitor CS1 and the second capacitor CS2. Herein, "C'" represents "CS1/(CS1+CS2+Coled')", and "Coled'" represents a capacitance of the OLED.

Then, the third switching thin-film transistor ST3 is turned on during the emission period t4. Thereafter, the Vdd voltage is applied to the drain electrode of the driving thin-film transistor DT via the third switching thin-film transistor ST3. Accordingly, the driving thin-film transistor DT supplies a driving current to the organic light emitting diode OLED. In this configuration, the driving current supplied from the driving thin-film transistor DT to the organic light emitting diode OLED is expressed by the following formula: $1/2*K(Vdata-Vref-C(Vdata-Vref))^2$. Herein, "K" represents a constant determined on the basis of the mobility and parasitic capacitance of the driving thin-film transistor DT.

In the following description, the arrangement relations among the driving components disposed in each of the plurality of pixels P of the organic light emitting display device 100 on a plane will be described in more detail with reference to FIG. 4.

Figure 4:
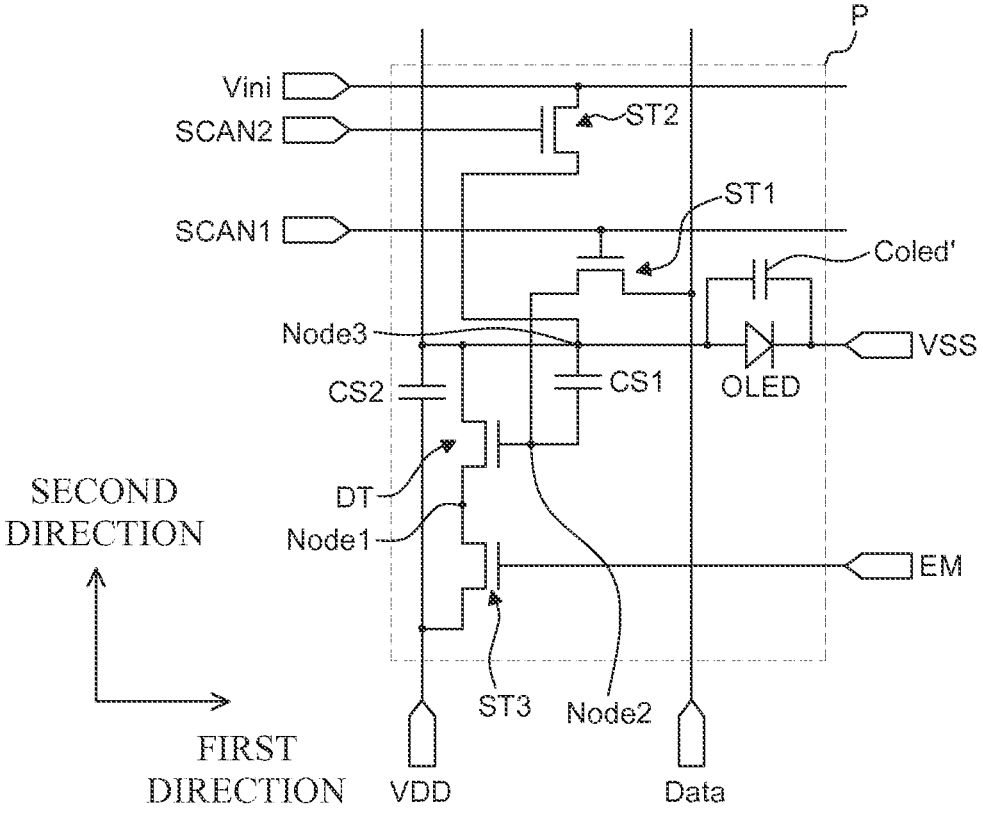
FIG. 4 is a schematic circuit diagram of one pixel of an organic light emitting display device according to an exemplary embodiment of the present disclosure.

FIG. 4 is a schematic circuit diagram of one pixel of the organic light emitting display device 100 according to an exemplary embodiment of the present disclosure. FIG. 4 illustrates an actual arrangement structure of each of lines, thin film transistors, and capacitors on a plane of one pixel P defined on the flexible substrate 110 of the organic light emitting display device 100.

Referring to FIG. 4, the first scan line SCAN1, the second scan line SCAN2, the emission line EM, and the initialization voltage supply line Vini are disposed to be extended in a first direction on the flexible substrate 110. Accordingly, the first scan line SCAN1, the second scan line SCAN2, the emission line EM, and the initialization voltage supply line Vini are also extended in the first direction in each of the plurality of pixels P. Further, the data line Data and the Vdd voltage supply line VDD are disposed to be extended in a second direction on the flexible substrate 110. Accordingly, the data line Data and the Vdd voltage supply line VDD are also extended in the second direction in each of the plurality of pixels P. The second direction is different from the first direction, and, for example, as illustrated in FIG. 4, the first direction may be an X-axis direction and the second direction may be a Y-axis direction.

Referring to FIG. 4, the second scan line SCAN2 is disposed on a plane of the pixel P, the first scan line SCAN1 is disposed under the second scan line SCAN2, the driving thin-film transistor DT is disposed under the first scan line SCAN1, and the emission signal line EM is disposed under the driving thin-film transistor DT. In particular, the source electrode of the driving thin-film transistor DT is disposed between the first scan line SCAN1 and the emission signal line EM. In addition, the initialization voltage supply line Vini is disposed at the uppermost portion in the pixel P, and the initialization voltage supply line Vini is disposed to be adjacent to the second scan line SCAN2. Accordingly, the second switching thin-film transistor ST2 is disposed between the initialization voltage supply line Vini and the first scan line SCAN1, and the first switching thin-film transistor ST1 and the driving thin-film transistor DT are disposed between the first scan line SCAN1 and the emission signal line EM.

In the method of riving the organic light emitting display device 100 according to an exemplary embodiment of the present disclosure, as illustrated in FIG. 3, during the emission period t4, the first scan line SCAN1 transfers a first scan signal as a low-level signal, the second scan line SCAN2 transfers a second scan signal as a low-level signal, and the emission signal line EM transfers an emission signal as a high-level signal. Further, during the emission period t4, when the driving thin-film transistor DT is turned on, a high-level signal is transferred to the source electrode of the driving thin-film transistor DT. Thus, in the organic light emitting display device 100 according to an exemplary embodiment of the present disclosure, the emission signal line EM configured to transfer a high-level signal during the emission period t4 and the driving thin-film transistor DT configured to receive a high-level signal are disposed at a lower portion on the plane in the pixel P. Further, the first scan line SCAN1, second scan line SCAN2 and initialization voltage supply line each configured to transfer a low-level signal during the emission period t4 are disposed at an upper portion on the plane in the pixel P. That is, if components each configured to be applied with a high-level signal and components each configured to be applied with a low-level signal are disposed alternately, an electric field is generated within a substrate between the components where the high-level signal is applied and the components where the low-level signal is applied, due to potential difference of the high-level signal and the low-level signal. Therefore, the components each configured to be applied with a high-level signal during the emission period t4 are grouped and disposed on one side of the pixel P and the components each configured to be applied with a low-level signal during the emission period t4 are grouped and disposed on the other side of the pixel P. Thus, a shift of the threshold voltage Vth of the thin-film transistor can be minimized.

An effect of the organic light emitting display device 100 according to an exemplary embodiment of the present disclosure and the method of driving the organic light emitting display device 100 will be described in more detail with reference to FIG. 5.

Figure 5:
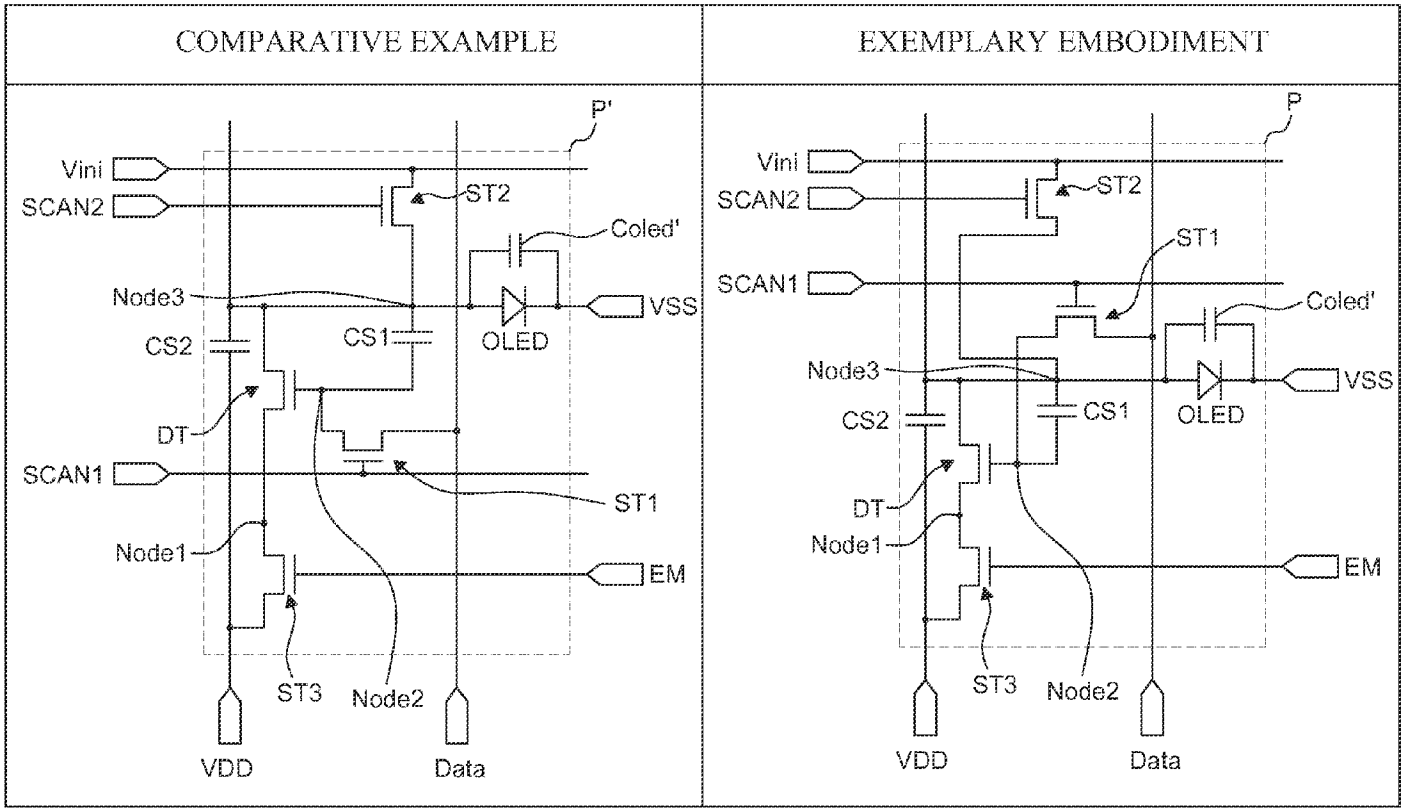
FIG. 5 shows schematic circuit diagrams of Comparative Example and an exemplary embodiment for describing an effect of an organic light emitting display device according to the exemplary embodiment of the present disclosure.

FIG. 5 shows schematic circuit diagrams of Comparative Example and an exemplary embodiment for describing an effect of an organic light emitting display device according to the exemplary embodiment of the present disclosure.

The exemplary embodiment illustrated in FIG. 5 is identical to the circuit diagram of the pixel P of the organic light emitting display device 100 according to an exemplary embodiment of the present disclosure as illustrated in FIG. 4.

Comparative Example illustrated in FIG. 5 is a circuit diagram of a pixel P' having an equivalent circuit to that of the circuit diagram of the pixel P of the organic light emitting display device 100 according to an exemplary embodiment of the present disclosure. However, it is positioned differently in arrangement of a line and a thin-film transistor on a plane. To be specific, in Comparative Example, the initialization voltage supply line Vini, the second scan line SCAN2, the driving thin-film transistor DT, the first scan line SCAN1, and the emission signal line EM are disposed in order from the top on the plane of the pixel P'. That is, in Comparative Example, the first scan line SCAN1 and the first switching thin-film transistor ST1 are disposed between the driving thin-film transistor DT and the emission signal line EM, whereas in the exemplary embodiment, the first scan line SCAN1 and the first switching thin-film transistor ST1 are disposed between the second scan line SCAN2 and the driving thin-film transistor DT. Accordingly, in the exemplary embodiment, the first scan line SCAN1 and the first switching thin-film transistor ST1 each configured to be applied with a low-level signal during the emission period t4 are disposed between the second scan line SCAN2 configured to be applied with a low-level signal and the source electrode of the driving thin-film transistor DT configured to be applied with a high-level signal. Whereas in Comparative Example, the first scan line SCAN1 and the first switching thin-film transistor ST1 are disposed between the emission signal line EM configured to be applied with a high-level signal and the source electrode of the driving thin-film transistor DT configured to be applied with a high-level signal during the emission period t4. Accordingly, a potential difference between the first switching thin-film transistor ST1 and its surrounding components is greater in Comparative Example than in the exemplary embodiment. Therefore, an intensity of an electric field applied to the first switching thin-film transistor ST1 is also higher in Comparative Example than in the exemplary embodiment. Thus, the first switching thin-film transistor ST1 in the exemplary embodiment is less affected by an electric field caused by a potential difference around the first switching thin-film transistor ST1 than the first switching thin-film transistor ST1 in Comparative Example. Therefore, a threshold voltage Vth of the first switching thin-film transistor ST1 is less shifted in the exemplary embodiment than in Comparative Example.

In some exemplary embodiments, the source electrode of the driving thin-film transistor DT may be disposed to be more adjacent to the first scan line SCAN1 than the drain electrode of the driving thin-film transistor DT. That is, the source electrode of the driving thin-film transistor DT may be disposed to be more adjacent to the first switching thin-film transistor ST1 than the drain electrode of the driving thin-film transistor DT. In an organic light emitting display device of the prior art, a drain electrode of a driving thin-film transistor is disposed in a region adjacent to a first scan line, and, thus, a strong electric field is generated between the first scan line and the drain electrode of the driving thin-film transistor. Therefore, a considerable amount of induced charge is formed within a flexible substrate, resulting in deterioration in property of the organic light emitting display device. Accordingly, in some exemplary embodiments, the source electrode of the driving thin-film transistor DT configured to be applied with a lower voltage than the drain electrode of the driving thin-film transistor DT during an emission period is disposed to be adjacent to the first scan line SCAN1, i.e., the first switching thin-film transistor ST1, so that an amount of induced charge accumulated in the flexible substrate 110 can be remarkably reduced.

A shift of a threshold voltage Vth of a thin-film transistor in the exemplary embodiment and Comparative Example will be described in more detail with reference to FIG. 6 to FIG. 8D.

Figure 6:
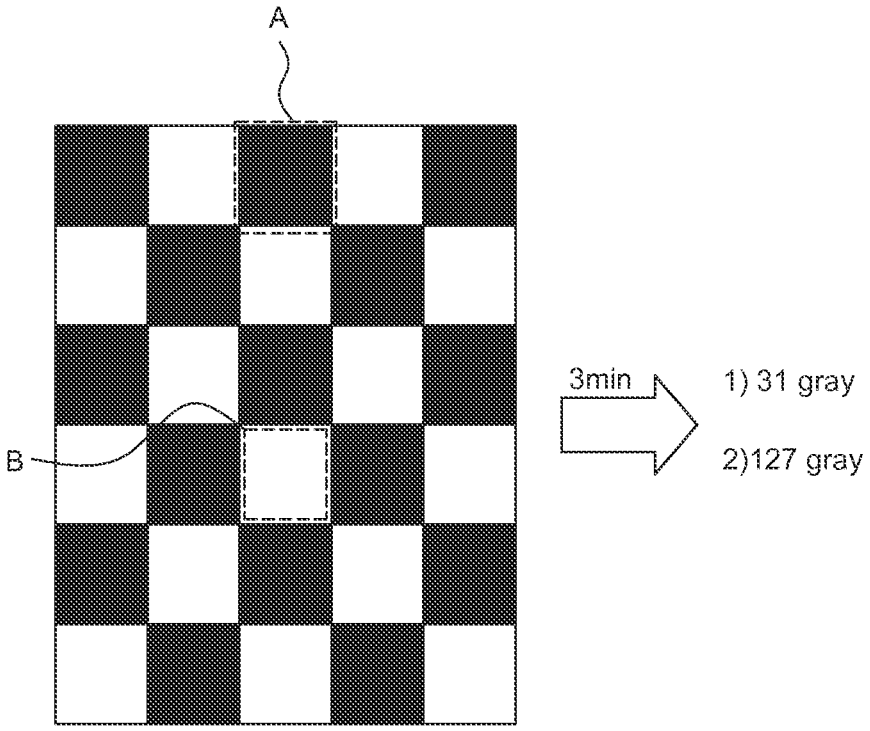
FIG. 6 is a schematic diagram for describing an evaluation method of an image sticking test.

FIG. 6 is a schematic diagram for describing an evaluation method of an image sticking test.

An image sticking test is a test in which a still image including a white pattern and a black pattern is switched to an image having a specific gray scale value after it has been displayed on an organic light emitting display device for a specific period of time and then, a maintenance time of image sticking of the previous image is measured. As an image sticking test, there may be used a visual evaluation in which visibility of the profile of a previous image after a switch of the image is determined with the naked eye. However, in the present specification, there is used an image sticking test in which a degree of image sticking is determined on the basis of a result of a current measurement in order to use an objectified value for evaluation.

To be specific, in the present specification, a chess pattern in which a white pattern and a black pattern are alternately disposed as illustrated in FIG. 6 was displayed on the organic light emitting display device including the pixel P' of Comparative Example and the organic light emitting display device 100 including the pixel P of the exemplary embodiment for 3 minutes. Then, each image was switched to a full-screen image having a gray scale value of 31 or a full-screen image having a gray scale value of 127 in order to compare Comparative Example with the exemplary embodiment. Then, after a specific period of time, a current Ia flowing in the pixels P and P' disposed in a portion A where the black pattern was displayed and a current Ib flowing in the pixels P and P' disposed in a portion B where the white pattern was displayed were measured and an ISC (Image Sticking Current) factor was calculated. As such, the image sticking test was conducted. To be specific, when the image was switched to the full-screen image having a gray scale value of 31, the currents Ia and Ib were measured 30 seconds after the switch of the image, and the ISC factor was calculated. When the image was switched to the full-screen image having a gray scale value of 127, the currents Ia and Ib were measured 5 seconds after the switch of the image, and the ISC factor was calculated.

The ISC factor was calculated by using the following equation.

$$\text{ISC factor}=(Ib-Ia)/(Ia+Ib) \quad (1)$$

Further, in the image sticking test according to the present specification, when the ISC factor had a value in a range of ±7.5×10E−3, the sample was determined as being normal. However, when the ISC factor had a value out of a range of ±7.5×10E−3, the sample was determined as being abnormal.

FIG. 7 is a table for describing a result of the image sticking test according to Comparative Example and the exemplary embodiment. FIG. 8A through FIG. 8D are graphs for describing the result of the image sticking test according to Comparative Example and the exemplary embodiment.

Figure 8A:
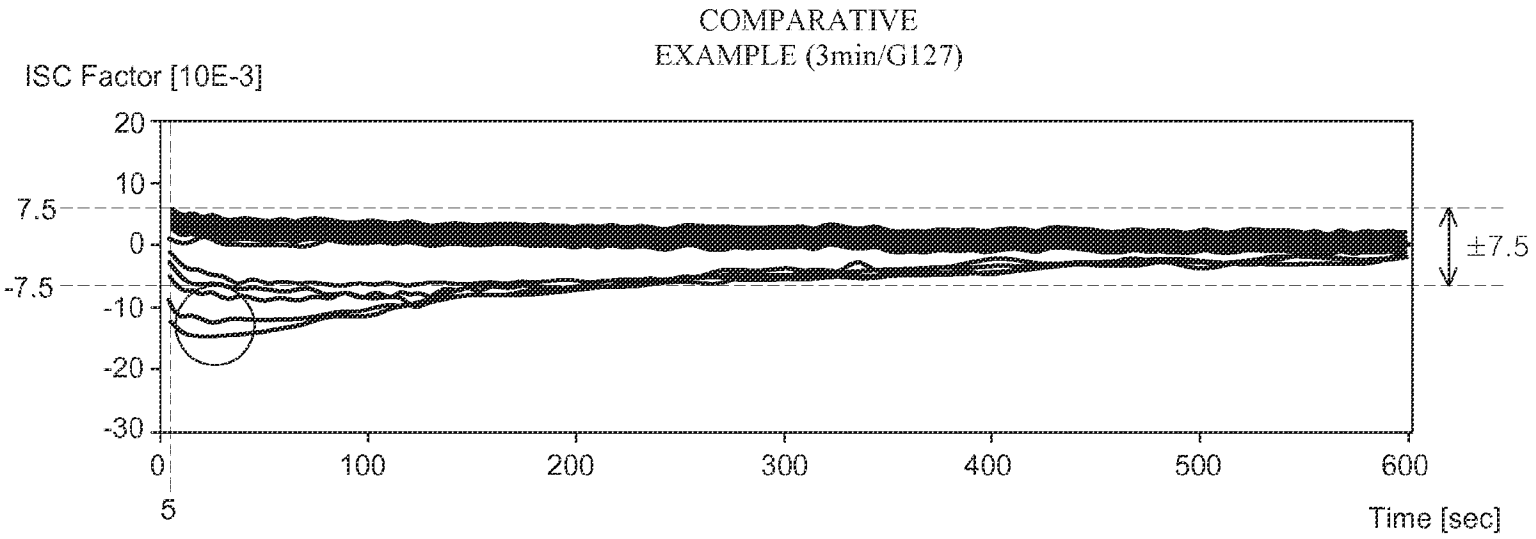
FIG. 8A to FIG. 8D are graphs for describing the result of the image sticking test according to Comparative Example and the exemplary embodiment.
Figure 8B:
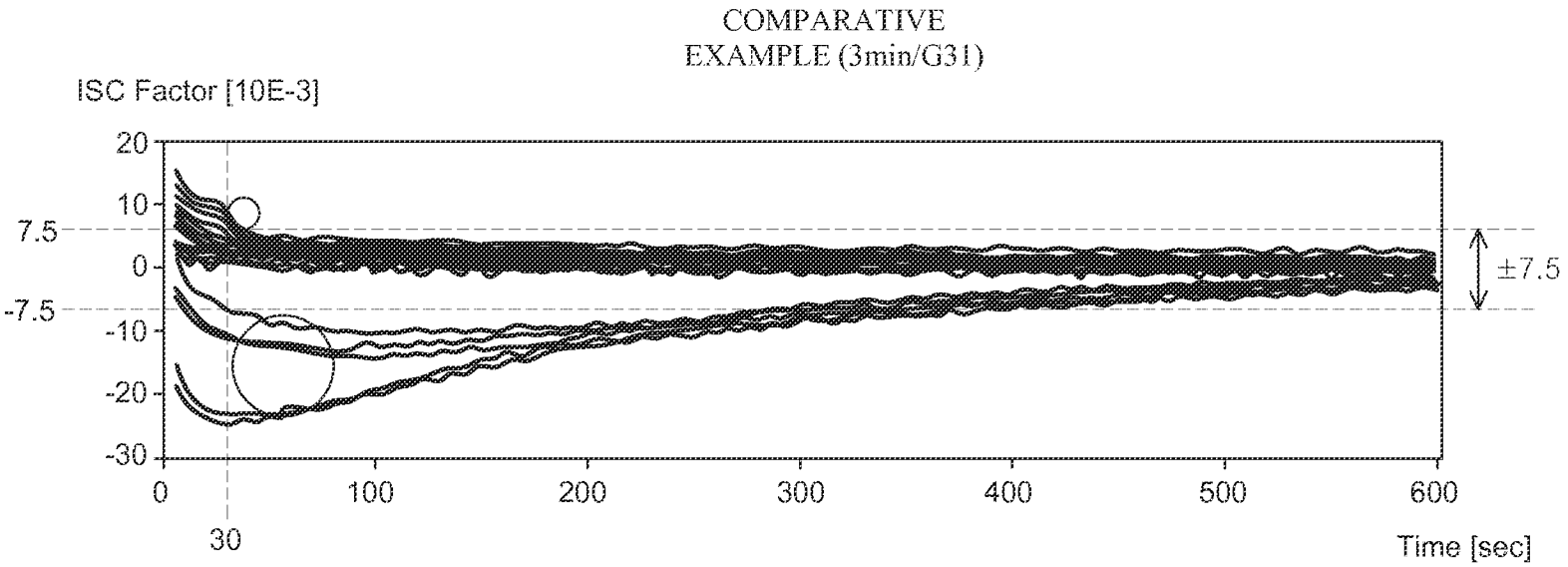
Figure 8C:
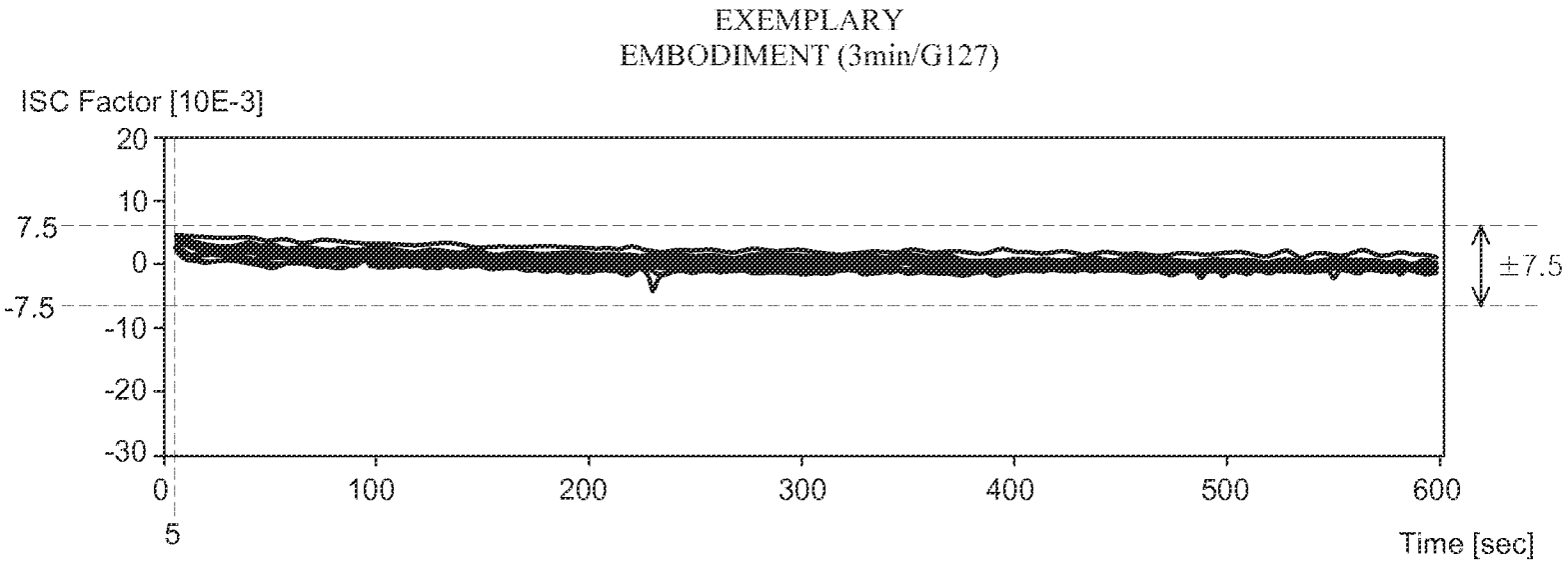

In the present specification, a current measurement was conducted on 30 samples in each of Comparative Example and the exemplary embodiment in order to increase accuracy of the image sticking test. In FIG. 7, each sample number is presented as "#N". In FIG. 7, "G127@5 s" is an ISC factor value after a lapse of 5 seconds from the time when an image was switched to a full-screen image having a gray scale value of 127 in each of Comparative Example and the exemplary embodiment. Further, "G31@30 s" is an ISC factor value after a lapse of 30 seconds from the time when an image was switched to a full-screen image having a gray scale value of 31 in each of Comparative Example and the exemplary embodiment. Further, as for the samples determined as being abnormal, ISC factor values are in the respective squares in FIG. 7. FIG. 8A is a graph showing a change in an ISC factor value with time when a chess pattern was displayed for 3 minutes on the 30 samples to which the pixel P' of Comparative Example was applied and then an image was switched to a full-screen image having a gray scale value of 127; FIG. 8B is a graph showing a change in an ISC factor value with time when a chess pattern was displayed for 3 minutes on the 30 samples to which the pixel P' of Comparative Example was applied and then an image was switched to a full-screen image having a gray scale value of 31; FIG. 8C is a graph showing a change in an ISC factor value with time when a chess pattern was displayed for 3 minutes on the 30 samples to which the pixel P of the exemplary embodiment was applied and then an image was switched to a full-screen image having a gray scale value of 127; and FIG. 8D is a graph showing a change in an ISC factor value with time when a chess pattern was displayed for 3 minutes on the 30 samples to which the pixel P of the exemplary embodiment was applied and then an image was switched to a full-screen image having a gray scale value of 31.

Referring to FIG. 7, FIG. 8A and FIG. 8B, a number of samples were determined as being abnormal as a result of the image sticking test on the 30 samples to which the pixel P' of Comparative Example was applied. Particularly, referring to FIG. 8A, when the image was switched to the full-screen image having a gray scale value of 127, the ISC factor value was out of a reference range at a reference time point, i.e., after a lapse of 5 seconds. It took about 200 seconds or more for all the ISC factor values of the 30 samples to be in the reference range. Further, referring to FIG. 8B, when the image was switched to the full-screen image having a gray scale value of 31, the ISC factor value was out of a reference range at a reference time point, i.e., after a lapse of 30 seconds, and it took about 400 seconds or more for all the ISC factor values of the 30 samples to be in the reference range. According to the result of the image sticking test, it can be seen that it takes a considerable amount of time for image sticking to disappear from the samples to which the pixel P' of Comparative Example was applied.

Figure 8D:
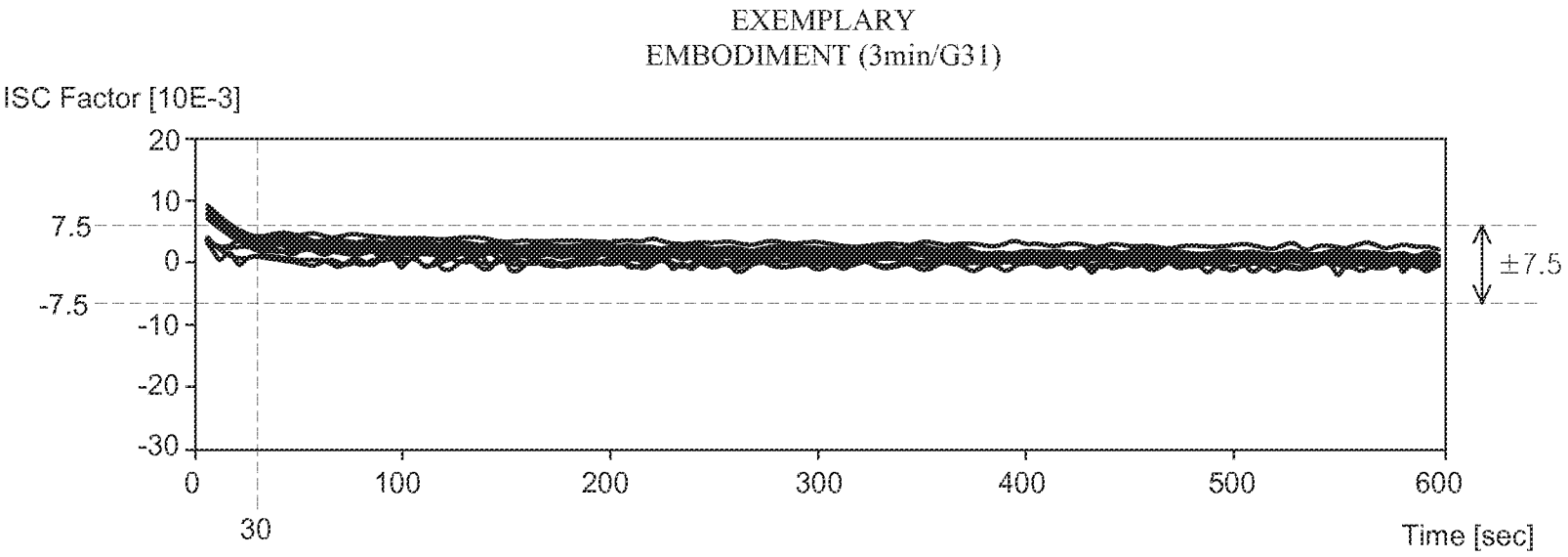

Referring to FIG. 7, FIG. 8C and FIG. 8D, there was no abnormal sample as a result of the image sticking test on the 30 samples to which the pixel P of the exemplary embodiment was applied. According to the result of the image sticking test, it can be seen that within a target time, image sticking disappears from the samples to which the pixel P of the exemplary embodiment was applied.

In short, according to the result of the image sticking test as shown in FIG. 6 to FIG. 8D, it is confirmed that it takes a considerable amount of time for image sticking to disappear in Comparative Example, whereas image sticking disappears in a relatively short period of time in the exemplary embodiment. This is because the pixel P' of Comparative Example is different from the pixel P of the exemplary embodiment as described above.

To be specific, in Comparative Example, the first scan line SCAN1 and the first switching thin-film transistor ST1 are disposed between the driving thin-film transistor DT and the emission signal line EM. Further, during the emission period t4, a low-level signal is applied to the first scan line SCAN1 and the first switching thin-film transistor ST1 and a high-level signal is applied to the source electrode of the driving thin-film transistor DT and the emission signal line EM. Further, since the flexible substrate 110 holds water, an electric field caused by the water in the flexible substrate 110 is generated between the first switching thin-film transistor ST1 and the source electrode of the driving thin-film transistor DT and between the first switching thin-film transistor ST1 and the emission signal line EM. Accordingly, a threshold voltage Vth of the first switching thin-film transistor ST1 in the pixel P' disposed in a portion where the white pattern of the chess pattern is displayed is shifted. However, the pixel P' disposed in a portion where the black pattern is displayed does not emit light, and, thus, a threshold voltage Vth of the first switching thin-film transistor ST1 in the corresponding pixel P' is not shifted. Accordingly, a threshold voltage Vth of the first switching thin-film transistor ST1 varies depending on a position of the pixel P' disposed in the image, and, thus, an amount of current flowing in the organic light emitting diode OLED of each pixel P' is also different from each other. Therefore, when a signal for displaying an image having the same gray scale value is applied to all of the pixels P', but actually, a gray scale value in each of the pixels P' becomes different from each other and image sticking can be seen with the naked eye.

Meanwhile, in the organic light emitting display device 100 according to an exemplary embodiment of the present disclosure, the first scan line SCAN1 and the first switching thin-film transistor ST1 are disposed between the second scan line SCAN2 and the driving thin-film transistor DT. Further, during the emission period t4, a low-level signal is applied to the second scan line SCAN2, the first scan line SCAN1, and the first switching thin-film transistor ST1 but a high-level signal is applied to the source electrode of the driving thin-film transistor DT. That is, in the organic light emitting display device 100 according to an exemplary embodiment of the present disclosure, the components each configured to be applied with a high-level signal during the emission period t4 are grouped and disposed on one side of the pixel P and the components each configured to be applied with a low-level signal during the emission period t4 are grouped and disposed on the other side of the pixel P. Therefore, it is possible to minimize generation of an electric field caused by a potential difference and also possible to minimize a shift of a threshold voltage Vth of the first switching thin-film transistor ST1 caused by the electric field. Accordingly, as can be seen from FIG. 7, FIG. 8C and FIG. 8D, it is confirmed that image sticking cannot be seen from the organic light emitting display device 100 according to an exemplary embodiment of the present disclosure.

According to another feature of the present disclosure, in each of the plurality of pixels, the first scan line, the second scan line, the driving thin-film transistor, and the emission signal line are disposed in an order from the second scan line, the first scan line, the driving thin-film transistor, and the emission signal line on a plane.

According to yet another feature of the present disclosure, when the organic light emitting diode emits light, the first scan line and the second scan line transfer a low-level signal, the emission signal line transfers a high-level signal, and a high-level signal is transferred to the source electrode of the driving thin-film transistor.

According to still another feature of the present disclosure, the flexible substrate is a plastic substrate.

According to still another feature of the present disclosure, the flexible substrate is formed of polyimide.

According to still another feature of the present disclosure, a gate electrode of the first switching thin-film transistor is connected with the first scan line, a gate electrode of the second switching thin-film transistor is connected with the second scan line, and a gate electrode of the third switching thin-film transistor is connected with the emission signal line.

According to still another feature of the present disclosure, the first switching thin-film transistor, the second switching thin-film transistor, the third switching thin-film transistor, and the driving thin-film transistor are LTPS (Low Temperature Poly Silicon) thin-film transistors.

According to still another feature of the present disclosure, the organic light emitting display device further includes: an organic light emitting diode disposed on each of the plurality of pixels, and the source electrode of the driving thin-film transistor is connected with the organic light emitting diode.

According to still another feature of the present disclosure, in each of the plurality of pixels, the initialization voltage supply line is disposed to be adjacent to the second scan line.

According to still another feature of the present disclosure, the organic light emitting display device further includes: a first capacitor connected between the gate electrode of the driving thin-film transistor and the source electrode of the driving thin-film transistor; and a second capacitor connected between the Vdd voltage supply line and the drain electrode of the driving thin-film transistor.

According to still another feature of the present disclosure, the source electrode of the driving thin-film transistor is disposed between the first scan line and the emission signal line.

According to still another feature of the present disclosure, the flexible substrate holds water therein.

According to another feature of the present disclosure, during the emission period, a high-level signal is transferred to the source electrode of the driving thin-film transistor.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purposes only but not intended to limit the technical concept of the present disclosure. The scope of the technical concept of the present disclosure is not limited thereto. The protective scope of the present disclosure should be construed based on the following claims, and all the technical concepts in the equivalent scope thereof should be construed as falling within the scope of the present disclosure.

What is claimed is:

1. An organic light emitting display device comprising:

a plurality of pixels defined on a flexible substrate;

an organic light emitting diode disposed on each of the plurality of pixels;

a first scan line, a second scan line, an emission signal line, and an initialization voltage supply line extended in a first direction with respect to each of the plurality of pixels; and a data line and a Vdd voltage supply line extended in a second direction with respect to each of the plurality of pixels, wherein each of the plurality of pixels includes:

a first switching thin-film transistor connected with the first scan line and the data line;

a second switching thin-film transistor connected with the second scan line and the initialization voltage supply line;

a third switching thin-film transistor connected with the emission signal line and the Vdd voltage supply line; and a driving thin-film transistor including a gate electrode connected with the first switching thin-film transistor, a source electrode connected with the second switching thin-film transistor and the organic light emitting diode, and a drain electrode connected with the third switching thin-film transistor, wherein the first scan line and the second scan line are grouped and disposed on one side on a plane of each of the plurality of pixels, and the driving thin-film transistor and the emission signal line are grouped and disposed on another side in each of the plurality of pixels, and wherein when the organic light emitting diode emits light, the first scan line and the second scan line transfer a low-level signal, the emission signal line transfers a high-level signal, and a high-level signal is transferred to the source electrode of the driving thin-film transistor.

2. The organic light emitting display device according to claim 1, wherein in each of the plurality of pixels, the first scan line, the second scan line, the driving thin-film transistor, and the emission signal line are disposed in an order from the second scan line, the first scan line, the driving thin-film transistor, and the emission signal line on a plane.

3. The organic light emitting display device according to claim 1, wherein the flexible substrate is a plastic substrate.

4. The organic light emitting display device according to claim 3, wherein the flexible substrate is formed of polyimide.

5. The organic light emitting display device according to claim 1, wherein a gate electrode of the first switching thin-film transistor is connected with the first scan line, a gate electrode of the second switching thin-film transistor is connected with the second scan line, and a gate electrode of the third switching thin-film transistor is connected with the emission signal line.

6. The organic light emitting display device according to claim 1, wherein the first switching thin-film transistor, the second switching thin-film transistor, the third switching thin-film transistor, and the driving thin-film transistor are LTPS (Low Temperature Poly Silicon) thin-film transistors.

7. The organic light emitting display device according to claim 1, further comprising:

an organic light emitting diode disposed on each of the plurality of pixels, wherein the source electrode of the driving thin-film transistor is connected with the organic light emitting diode.

8. The organic light emitting display device according to claim 1, wherein in each of the plurality of pixels, the initialization voltage supply line is disposed adjacent to the second scan line.

9. The organic light emitting display device according to claim 1, further comprising:

a first capacitor connected between the gate electrode of the driving thin-film transistor and the source electrode of the driving thin-film transistor; and a second capacitor connected between the Vdd voltage supply line and the drain electrode of the driving thin-film transistor.

10. The organic light emitting display device according to claim 1, wherein the source electrode of the driving thin-film transistor is disposed between the first scan line and the emission signal line.

11. A method of driving the organic light emitting display device comprising:

a plurality of pixels defined on a flexible substrate;

an organic light emitting diode disposed on each of the plurality of pixels;

a first scan line, a second scan line, an emission signal line, and an initialization voltage supply line extended in a first direction with respect to each of the plurality of pixels; and a data line and a Vdd voltage supply line extended in a second direction with respect to each of the plurality of pixels, wherein each of the plurality of pixels includes:

a first switching thin-film transistor connected with the first scan line and the data line;

a second switching thin-film transistor connected with the second scan line and the initialization voltage supply line;

a third switching thin-film transistor connected with the emission signal line and the Vdd voltage supply line; and a driving thin-film transistor including a gate electrode connected with the first switching thin-film transistor, a source electrode connected with the second switching thin-film transistor and the organic light emitting diode, and a drain electrode connected with the third switching thin-film transistor, and wherein the first scan line and the second scan line are grouped and disposed on one side on a plane of each of the plurality of pixels, and the driving thin-film transistor and the emission signal line are grouped and disposed on another side in each of the plurality of pixels, the method comprising:

applying a pulse signal through the first scan line, the second scan line, and the emission signal line during an initialization period, a sampling period, a programming period, and an emission period, wherein during the emission period, the first scan line and the second scan line transfer a low-level signal and the emission signal line transfers a high-level signal.

12. The method of driving the organic light emitting display device according to claim 11, wherein during the emission period, a high-level signal is transferred to the source electrode of the driving thin-film transistor.

* * * * *